US009281145B2

(12) United States Patent
Wang et al.

(10) Patent No.: US 9,281,145 B2
(45) Date of Patent: Mar. 8, 2016

(54) VACUUM INTERRUPTER

(71) Applicant: Xi'an Jiaotong University, Xi'an (CN)

(72) Inventors: Jianhua Wang, Xi'an (CN); Jing Yan, Xi'an (CN); Yingsan Geng, Xi'an (CN); Zhiyuan Liu, Xi'an (CN); He Yang, Xi'an (CN)

(73) Assignee: Xi'an Jiaotong University, Xi'an (CN)

( * ) Notice: Subject to any disclaimer, the term of this patent is extended or adjusted under 35 U.S.C. 154(b) by 0 days.

(21) Appl. No.: 14/280,661

(22) Filed: May 18, 2014

(65) Prior Publication Data

US 2014/0251958 A1 Sep. 11, 2014

Related U.S. Application Data

(63) Continuation-in-part of application No. PCT/CN2012/071840, filed on Mar. 2, 2012.

(51) Int. Cl.
*H01H 33/662* (2006.01)

(52) U.S. Cl.
CPC ..... *H01H 33/662* (2013.01); *H01H 33/66261* (2013.01); *H01H 2033/66284* (2013.01)

(58) Field of Classification Search
CPC H01H 33/66; H01H 33/66261; H01H 33/662
USPC ..... 200/144; 218/118, 129, 136, 140
See application file for complete search history.

(56) References Cited

U.S. PATENT DOCUMENTS 4,061,894 A * 12/1977 Crouch ..... 218/136
4,361,742 A * 11/1982 Kashiwagi et al. ..... 218/136
2013/0284704 A1* 10/2013 Gentsch ..... 218/140

FOREIGN PATENT DOCUMENTS

JP 2007012390 A * 1/2007 ..... H01H 33/66

* cited by examiner

*Primary Examiner* — Amy Cohen Johnson
*Assistant Examiner* — Marina Fishman
(74) *Attorney, Agent, or Firm* — Matthias Scholl, PC; Matthias Scholl

(57) ABSTRACT

A vacuum interrupter, including: an insulating housing; a movable end cap; a stationary end cap; a pair of movable and stationary contacts; and a pair of shields. The pair of shields is fixed on the movable end cap and the stationary end cap, respectively. The insulating housing, the movable end cap, and the stationary end cap cooperate to form a closed space. The closed space includes a movable fracture and a stationary fracture. The movable fracture is formed by the pair of movable and stationary contacts for carrying rated current and disconnecting capacitive load whereby achieving breaking performance of the vacuum interrupter. The stationary fracture is formed by the pair of shields. When the pair of stationary and movable contacts reaches a full open position, the stationary contact and the movable contact enter the pair of shields, respectively.

2 Claims, 3 Drawing Sheets

VACUUM INTERRUPTER

CROSS-REFERENCE TO RELATED APPLICATIONS

This application is a continuation-in-part of International Patent Application No. PCT/CN2012/071840 with an international filing date of Mar. 2, 2012, designating the United States, now pending, the contents of which, are incorporated herein by reference. Inquiries from the public to applicants or assignees concerning this document or the related applications should be directed to: Matthias Scholl P.C., Attn.: Dr. Matthias Scholl Esq., 14781 Memorial Drive, Suite 1319, Houston, Tex. 77079.

BACKGROUND OF THE INVENTION

1. Field of the Invention

The invention relates to a vacuum interrupter.

2. Description of the Related Art

Recent studies have found that the heavy breakdown has an affinity to the high-frequency inrush current. As the contact surface is locally ablated by the high-frequency current during the close of the switch, fusion welding occurs on the contact, and the surface structure of the contact is damaged, thereby increasing the field emission coefficient $\beta$ of the contact surface.

A typical vacuum interrupter generally includes a pair of movable contacts. For example, a power-off and disconnecting switch device equipped with a vacuum box includes different positions of movable contacts inside the vacuum interrupter for controlling the connection, breaking, and disconnection of the current. For another example, a high voltage vacuum switch achieves anti-high-voltage property of the vacuum interrupter by controlling a pair of the movable contacts to be disposed inside a pair of shield contacts at a full open position. Although multiple working positions of the vacuum interrupter are disposed, the current breaking function is not independent from the insulating function after the disconnection.

SUMMARY OF THE INVENTION

In view of the above-described problems, it is one objective of the invention to provide a vacuum interrupter that has independent breaking function and insulating function and employs a movable contact to achieve the breaking function and a stationary contact to achieve the insulating function. Besides, the vacuum interrupter is applicable to in breaking the capacitive load, such as, a back-to-back capacitor bank and a single capacitor bank, and particularly applicable to the field of the reactive power compensation in the electric power system.

To achieve the above objective, in accordance with one embodiment of the invention, there is provided a vacuum interrupter, comprising: an insulating housing; a movable end cap; a stationary end cap; a pair of movable and stationary contacts; and a pair of shields. The pair of shields is fixed on the movable end cap and the stationary end cap, respectively. The insulating housing, the movable end cap, and the stationary end cap cooperate to form a closed space having a vacuum state. The closed space comprises a movable fracture and a stationary fracture. The movable fracture is formed by the pair of movable and stationary contacts for carrying rated current and disconnecting capacitive load whereby achieving breaking performance of the vacuum interrupter. The stationary fracture is formed by the pair of shields which are fixed on the movable end cap and the stationary end cap, respectively. When the pair of stationary and movable contacts reach a full open position, the stationary contact and the movable contact enter the pair of shields, respectively, so that a DC recovery voltage resulting from the break of capacitive current is exerted on the stationary fracture whereby achieving insulating performance of the vacuum interrupter.

In a class of this embodiment, one or several of the movable fracture(s) are provided. The vacuum interrupter comprising a plurality of the stationary fractures is advantageous in that the DC recovery voltage after breaking the capacitive current is exerted on the stationary fractures. When one stationary fracture is broken down, other stationary fractures will not be broken down simultaneously, thus, the line current will not be produced, that is, the heavy breakdown phenomenon will not occur in the vacuum interrupter. The delay heavy breakdown of the vacuum interrupter during the switching of the capacitive load is effectively decreased.

In a class of this embodiment, the vacuum interrupter comprising the stationary fracture is applicable to an operating mechanism to form a vacuum load switch, a vacuum contactor, or a vacuum breaker. Meanwhile, the vacuum load switch and the vacuum contactor formed by the vacuum interrupter are able to match with a fuse to form a special combined electrical apparatus for switching capacitive load.

BRIEF DESCRIPTION OF THE DRAWINGS

The invention is described hereinbelow with reference to the accompanying drawings, in which.

Figure 1:
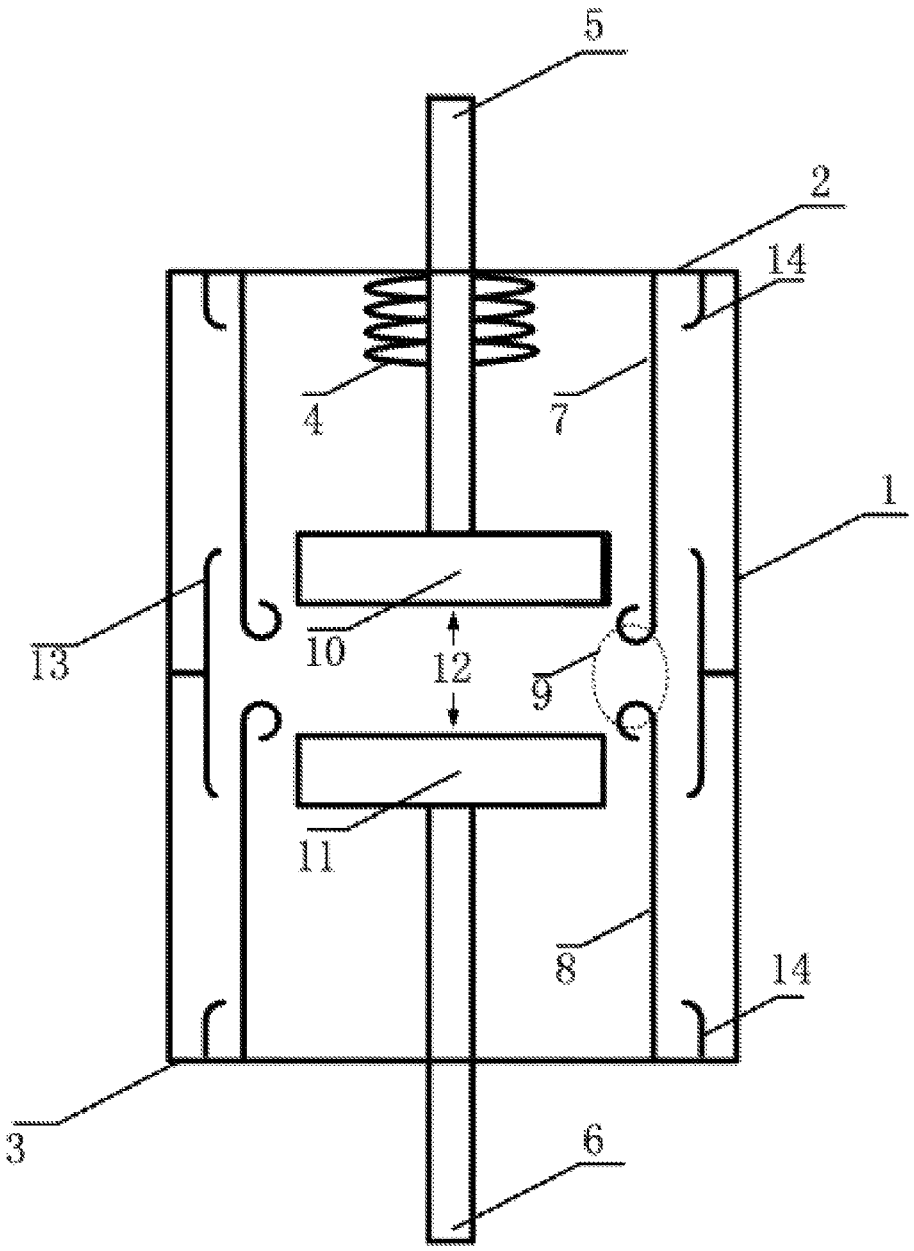
FIG. 1 is a cross-sectional view of a vacuum interrupter comprising one stationary fracture in accordance with one embodiment of the invention.

In the drawings, the following reference numbers are used: 1. Insulating housing; 2. Movable end cover; 3. Stationary end cover; 4. Bellows; 5. Movable conductive rod; 6. Stationary conductive rod; 7. Movable end shield; 8. Fixed end shield; 9. Stationary fracture; 10. Movable contact; 11. Stationary contact; 12. Movable fracture; 13. Main shield; 14. End shield; 201. First insulating housing; 202. Second insulating housing; 203. First movable end cap; 204. Second movable end cap; 205. Stationary end plate; 206. First bellows; 207. Second bellows; 208. First movable conductive rod; 209. Second movable conductive rod; 210. First movable end shield; 211. Second movable end shield; 212. Stationary end shield; 213. First stationary fracture; 214. Second stationary fracture; 215. First movable contact; 216. Second movable contact; 217. Stationary contact; 218. First movable fracture; 219. Second movable fracture; 301. Insulating housing; 302. Movable end cap; 303. Stationary end cap; 304. Bellows; 305. Movable conductive rod; 306. Stationary conductive rod; 307. Movable end shield; 308. Stationary end shield; 309. First shield; 310. Second shield; 311. Movable contact; 312. Stationary contact; 313. Movable fracture; 314. First stationary fracture; 315. Second stationary fracture; and 316. Third stationary fracture.

DETAILED DESCRIPTION OF THE EMBODIMENTS

For further illustrating the invention, experiments detailing a vacuum interrupter are described below. It should be noted that the following examples are intended to describe and not to limit the invention.

As shown in FIG. 1, a vacuum interrupter comprising one stationary fracture comprises a closed space formed by an insulating housing 1, a movable end cap 2, and a stationary end cap 3; and an inner part of the closed space is in the vacuum state. A movable conductive rod 5 passes through the movable end cap 2 to allow one end of the movable conductive rod 5 to be disposed inside the closed space and the other end of the movable conductive rod 5 to be disposed outside the closed space, and the movable conductive rod 5 is capable of moving upward and downward. The end of the movable conductive rod 5 disposed inside the closed space is nested within a bellows 4 and comprises an end point being fixed together with a movable contact 10. One end of the bellows 4 is fixed on the movable end cap 2, and the other end of the bellows 4 is fixed on the movable conductive rod 5. A stationary conductive rod 6 passes through the stationary end cap 3 to allow one end of the stationary conductive rod 6 to be disposed inside the closed space and the other end of the stationary conductive rod 6 to be disposed outside the closed space. A stationary contact 11 is fixed on an end point of the end of the stationary conductive rod 6 disposed inside the closed space. The movable fracture 12 is formed between the movable contact 10 and the stationary contact 11. The stationary fracture 9 is formed by a movable end shield 7 and a stationary end shield 8 inside the closed space. The movable end shield 7 and the movable end cap 2 are fixed together, and the stationary end shield 8 and the stationary end cap 3 are fixed together. The movable contact 10 and the stationary contact 11 respectively enter the movable end shield 7 and the stationary end shield 8 after reaching the full open position.

A main shield 13 is disposed inside the closed space and is fixed on a middle part of the insulating housing 1 of the vacuum interrupter outside the stationary fracture 9.

An inner part of the closed space is provided with end shields 14, the end shields 14 are fixed on the movable end cap 2 and the stationary end cap 3 outside the movable end shield 7 and stationary end shield 8, respectively.

Working principle of the vacuum interrupter is as follows: in the process of closing the capacitive load, the movable contact 10 moves close to the stationary contact 11 under the force of an operating mechanism. When the movable fracture 12 is unable to bear the voltage exerted between the contacts, the pre-breakdown phenomenon occurs, the rated current rushes from the movable contact 10 to the stationary contact 11, and finally the two contacts press against each other. When the capacitive load is disconnected, the movable contact 10 is separated from the stationary contact 11 and produces an electric arc under the force of the operating mechanism, and the arc disappears at the current zero, thus, the breaking of the capacitive current is finished by the movable fracture 12. When the movable fracture 12 reaches a full open position, the movable contact 10 and the stationary contact 11 enter the movable end shield 7 and the stationary end shield 8, respectively. From the perspective of the electric field distribution, the movable contact 10 and the stationary contact 11 are shielded by the movable end shield 7 and the stationary end shield 8, respectively, and the DC recovery voltage is exerted on the stationary fracture 9, that is, the insulating performance of the vacuum interrupter is determined by the stationary fracture 9. In the whole switching process, only the surfaces of the movable contact 10 and the stationary contact 11 will be eroded or damaged by the current, but the insulating performance of the vacuum interrupter will not decrease. Thus, the heavy breakdown probability during the breaking of the capacitive current is effectively decreased.

Figure 2:
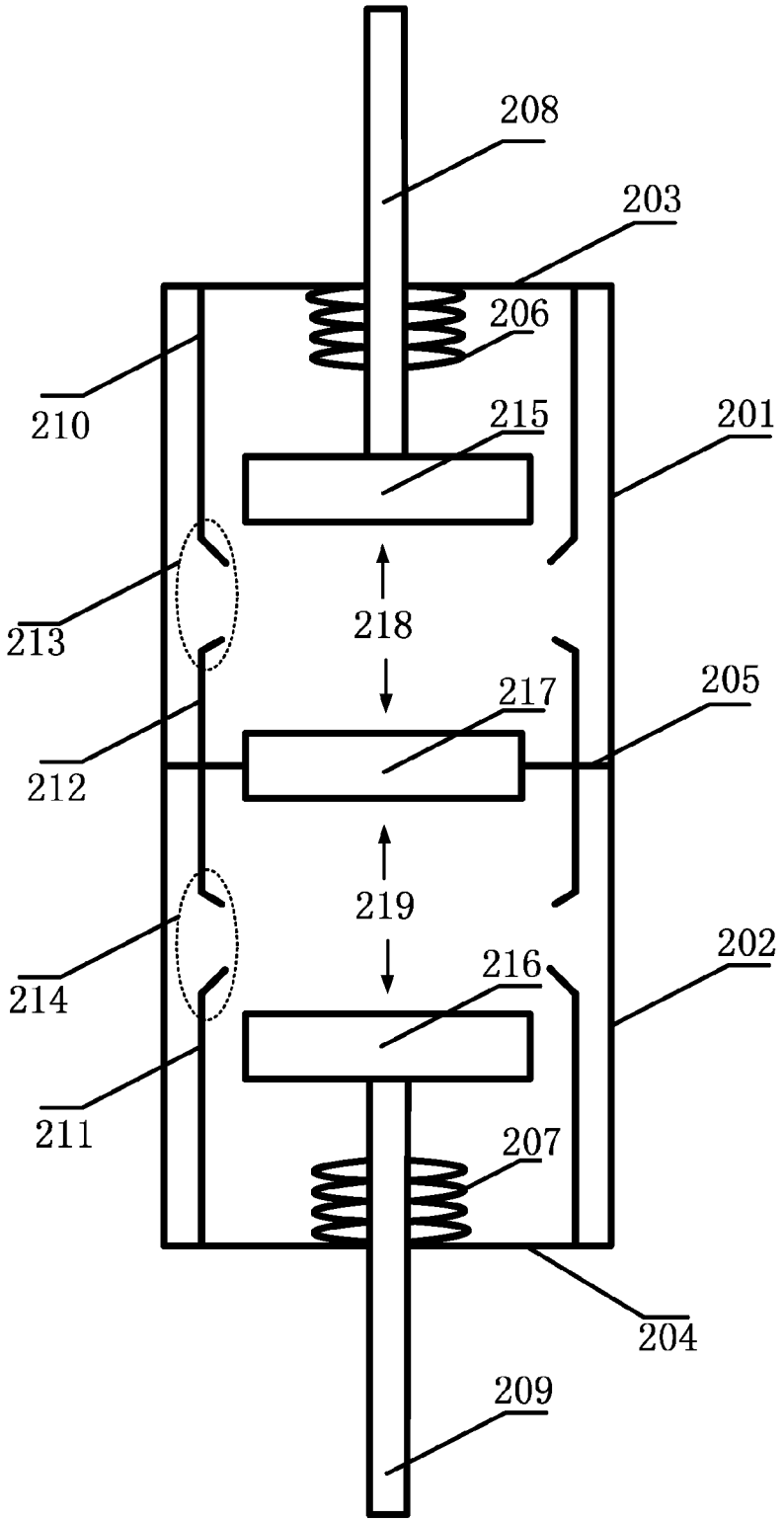
FIG. 2 is a cross-sectional view of a vacuum interrupter comprising two stationary fractures in accordance with one embodiment of the invention.

The number of the movable contact and the stationary contact can be one or several, respectively. As shown in FIG. 2, the number of the movable fractures and the fixed fractures are two. The vacuum interrupter comprises a closed space formed by a first insulating housing 201, a second insulating housing 202, a first movable end cap 203, and a second movable end cap 204. An inner part of the closed space is in the vacuum state. A middle part of the closed space is provided with a stationary end plate 205. The closed space is divided into a first closed space and a second closed space by the stationary end plate 205. The stationary contact 217 is fixed on the stationary end plate 205. A first movable conductive rod 208 passes through the first movable end cap 203, one end of the first movable conductive rod 208 is disposed inside the closed space, and the other end of the movable conductive rod 208 is disposed outside the closed space. The first movable conductive rod 208 is capable of moving upward and downward. The end of the first movable conductive rod 208 disposed inside the first closed space is nested within a first bellows 206 and comprises an end point being fixed together with a first movable contact 215. One end of the first bellows 206 is fixed on the first movable end cap 203, and the other end of the first bellows 206 is fixed on the first movable conductive rod 208. The second movable conductive rod 209 passes through the second movable end cap 204. One end of the second movable conductive rod 209 is disposed inside the second closed space, and the other end of the second movable conductive rod 209 is disposed outside the second closed space. The second movable conductive rod 209 is capable of moving upward and downward. The end of the second movable conductive rod 209 disposed inside the second closed space is nested within a second bellows 207 and comprises an end point being fixed together with a second movable contact 216. One end of the second bellows 207 is fixed on the second movable end cap 204, and the other end of the second bellows 207 is fixed on the second movable conductive rod 209. A first movable fracture 218 is formed between the first movable contact 215 and the stationary contact 217. A second movable fracture 219 is formed between the second movable contact 216 and the stationary contact 217. A first movable end shield 210 is fixed on the first movable end cap 203, a second movable end shield 211 is fixed on the second movable end cap 204. A stationary end shield 212 is fixed on the stationary end plate 205. A first stationary fracture 213 is formed between a first movable end shield 210 and the stationary end shield 212, and a second stationary fracture 214 is formed between the second movable end shield 211 and the stationary shield 212. The first movable contact 215 and the second movable contact 216 enter the first movable end shield 210 and the second movable end shield 211, respectively, when the first movable fracture 218 and the second movable fracture 219 reach a full open position. The first movable contact 215, the second movable contact 216, and the stationary contact 217 are shielded by the first movable end shield 210, the second movable end shield 211, and the stationary end shield 212, respectively, from the perspective of the electric field distribution.

Working principle of the vacuum interrupter comprising the two stationary fractures is as follows: in the process of closing the capacitive load, the rated current is carried by the first movable contact 215, the second movable contact 216, and the stationary contact 217, while the first movable fracture 218 and the second movable fracture 219 formed by the three contacts are used to finish the breaking function of the capacitive current during the disconnection of the capacitive load. When the first movable fracture 218 and the second movable fracture 219 reach the full open position, the first movable contact 215 and the second movable contact 216 move inside the first movable end shield 210 and the second movable end shield 211, respectively. From the perspective of the electric field distribution, the first movable contact 215, the second movable contact 216, and the stationary contact 217 are shielded by the first movable end shield 210, the second movable end shied 211, and the stationary end shield 212, respectively; and the DC recovery voltage is exerted on both the first stationary fracture 213 and the second stationary fracture 214. As long as the two stationary fractures are not broken down simultaneously, the line current will not be produced, that is, the heavy breakdown phenomenon will not occur in the vacuum interrupter. Thus, the performance of the vacuum interrupter during the switching of the capacitive load is much reliable.

Figure 3:
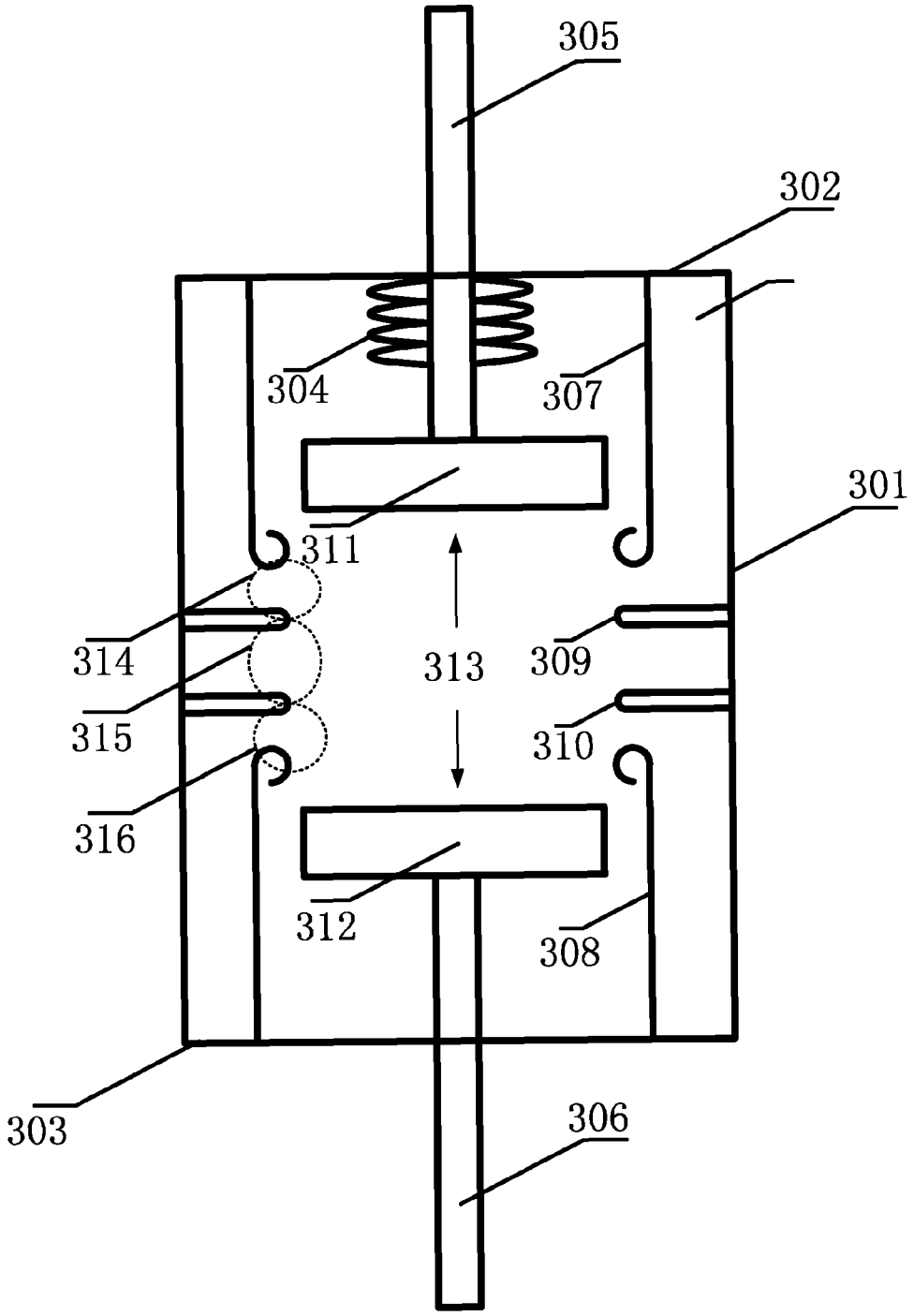
FIG. 3 is a cross-sectional view of a vacuum interrupter comprising three stationary fractures in accordance with one embodiment of the invention.

When the number of the stationary fractures is three, as shown in FIG. 3, the vacuum interrupter comprises the closed space formed by the insulating housing 301, the movable end cap 302, and the stationary end cap 303, and the inner part of the closed space is in the vacuum state. A movable conductive rod 305 passes through the movable end cap 302 to allow one end of the movable conductive rod 305 to be disposed inside the closed space and the other end of the movable conductive rod 305 to be disposed outside the closed space, and the movable conductive rod 305 is capable of moving upward and downward. The end of the movable conductive rod 305 disposed inside the closed space is nested within a bellows 304 and comprises an end point being fixed together with a movable contact 311. One end of the bellows 304 is fixed on the movable end cap 302, and the other end of the bellows 304 is fixed on the movable conductive rod 305. A stationary conductive rod 306 passes through the stationary end cap 303 to allow one end of the stationary conductive rod 306 to be disposed inside the closed space and the other end of the stationary conductive rod 306 to be disposed outside the closed space. A stationary contact 312 is fixed on an end point of the end of the stationary conductive rod 306 disposed inside the closed space. The movable fracture 313 is formed between the movable contact 311 and the stationary contact 312. The movable end shield 307 and the movable end cap 302 are fixed together, and the stationary end shield 308 and the stationary end cap 303 are fixed together. The movable contact 311 and the stationary contact 312 respectively enter the movable end shield 307 and the stationary end shield 308 when reaching the full open position. A first shield 309 and a second shield 310 are fixed inside the insulating housing 301. A first stationary fracture 314 is formed between the movable end shield 307 and the first shield 309. A second stationary fracture 315 is formed between the first shield 309 and the second shield 310. A third stationary fracture 316 is formed between the second shield 310 and the stationary shield 308.

Working principal of the vacuum interrupter comprising the three stationary fractures is as follows: in the process of closing the capacitive load, the rated current is carried by the movable contact 311 and the stationary contact 312, while the movable fracture formed by the two contacts are used to finish the breaking function of the capacitive current during the disconnection of the capacitive load. When the movable fracture 313 reaches the full open position, the movable contact 311 and the stationary contact 312 moves inside the movable end shield 307 and the stationary end shield 308, respectively. From the perspective of the electric field distribution, the movable contact 311 and the stationary contact 312 are shielded by the movable end shield 307 and the stationary end shield 308, respectively, and the DC recovery voltage is exerted on the first stationary fracture 314, the second stationary fracture 315, and the third stationary fracture 316, so that the performance of the vacuum interrupter during switching of the capacitive load is much reliable.

Furthermore, the vacuum interrupter comprising the stationary fracture is applicable to different operating mechanisms to form a vacuum load switch, a vacuum contactor, or a vacuum breaker. Meanwhile, the vacuum load switch and the vacuum contactor formed by the vacuum interrupter are able to match with a fuse to form a special combined electrical apparatus for switching the capacitive load. A protective property of the fuse is avoid from the inrush current in inputting capacitive load, that is, the fuse is not allowed to move during the inrush phase. Under a rated working condition, the protective property of the fuse matches with load characteristics. In failure cases, a firing pin device carried by the fuse make the vacuum load switch or the vacuum contactor finish the break-brake operation.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. A vacuum interrupter, comprising:

a first insulating housing;
a second insulating housing;
a first end cap;
a second end cap;
a stationary end cap;
a first movable contact;
a second movable contact;
a first movable conductive rod;
a second movable conductive rod;
a stationary contact;
a first bellows;
a second bellows;
a first movable end shield;
a second movable end shield;
a stationary end shield; and
a stationary end plate;

wherein:

the first insulating housing, the second insulating housing, the first end cap, and the second end cap are connected to form a closed space;
the closed space is in a vacuum state;
the stationary end plate is disposed in a middle part of the closed space and divides the closed space into a first closed space and a second closed space;
the stationary contact is fixed on the stationary end plate;
the first movable conductive rod passes through the first end cap;
one end of the first movable conductive rod is disposed inside the first closed space, and the other end of the movable conductive rod is disposed outside the first closed space;
the first movable conductive rod is capable of moving upward and downward;
the end of the first movable conductive rod disposed inside the first closed space is nested within the first bellows and comprises an end point being fixed together with the first movable contact;
one end of the first bellows is fixed on the first end cap, and the other end of the first bellows is fixed on the first movable conductive rod;
the second movable conductive rod passes through the second end cap;

one end of the second movable conductive rod is disposed inside the second closed space, and the other end of the second movable conductive rod is disposed outside the second closed space;

the second movable conductive rod is capable of moving upward and downward;

the end of the second movable conductive rod disposed inside the second closed space is nested within the second bellows and comprises an end point being fixed together with the second movable contact;

one end of the second bellows is fixed on the second end cap, and the other end of the second bellows is fixed on the second movable conductive rod;

a first movable fracture is formed between the first movable contact and the stationary contact;

a second movable fracture is formed between the second movable contact and the stationary contact;

the first movable end shield is fixed on the first end cap;

the second movable end shield is fixed on the second end cap;

the stationary end shield is fixed on the stationary end plate;

a first stationary fracture is formed between the first movable end shield and the stationary end shield, and a second stationary fracture is formed between the second movable end shield and the stationary end shield; and when the first movable fracture and the second movable fracture reach a full open position, the first movable contact and the second movable contact enter the first movable end shield and the second movable end shield, respectively; and the first movable contact, the second movable contact, and the stationary contact are shielded by the first movable end shield, the second movable end shield, and the stationary end shield, respectively.

2. The vacuum interrupter of claim 1, wherein when the first movable fracture and the second movable fracture reach a full open position, a DC recovery voltage is exerted on the first stationary fracture and the second stationary fracture.

* * * * *